United States Patent [19]

Hoffmann et al.

[11] Patent Number: 4,558,646

[45] Date of Patent: Dec. 17, 1985

[54] PROJECTILE BODY WITH A ROTATING BAND OF PLASTIC

[75] Inventors: Dietrich Hoffmann, Schramberg; Udo Götz, Trossingen, both of Fed. Rep. of Germany

[73] Assignee: Mauser-Werke Oberndorf GmbH, Fed. Rep. of Germany

[21] Appl. No.: 651,598

[22] Filed: Sep. 17, 1984

[30] Foreign Application Priority Data

Sep. 21, 1983 [DE] Fed. Rep. of Germany ..... 3334022

[51] Int. Cl.[4] ..... F42B 31/00

[52] U.S. Cl. ..... 102/527

[58] Field of Search ..... 102/524–528

[56] References Cited

U.S. PATENT DOCUMENTS 2,310,915 2/1943 Harley ..... 102/526

FOREIGN PATENT DOCUMENTS 3142636 5/1983 Fed. Rep. of Germany ..... 102/527

*Primary Examiner*—Harold J. Tudor

*Attorney, Agent, or Firm*—McGlew and Tuttle

[57] ABSTRACT

A projectile particularly for use in rapid fire weapons and high performance guns comprises a hollow projectile body having an exterior surface with an annular groove therearound and with a plurality of openings formed in the groove at spaced circumferential locations. A rotating band is positioned in the groove and secured against displacement caused by centrifugal and accelerating forces, portions of the band which extend through the openings. The band is advantageously injection molded directly in the groove so that portions thereof form into the openings and extend through the openings and form a closed ring on the interior of the shell of the projectile body.

10 Claims, 6 Drawing Figures

PROJECTILE BODY WITH A ROTATING BAND OF PLASTIC

FIELD AND BACKGROUND OF THE INVENTION

This invention relates in general to ammunition and particular to a new and useful projectile but which includes a hollow projectile body having a exterior surface with an annular groove and with openings made in the groove through the wall of the body to the interior and with a rotating plastic band positioned in the groove and having portions thereof extending through the openings.

German OS No. 31 42 636 discloses a projectile body carrying an injection molded rotating band of plastic which is received in an annular groove in the rear portion of the projectile shell, with the groove being provided with spaced apart webs. The webs are frontally bent out and, in a preferred embodiment, have grooved or milled front faces, to ensure a firm hold of the rotating band even under high angular acceleration. These prior art projectiles have proved satisfactory in practice.

SUMMARY OF THE INVENTION

The present invention is directed to a projectile body in which the anchoring of the rotating band is further improved.

In accordance with the invention the projectile includes a hollow shell which has a groove around its exterior in which a rotating band is positioned and which includes holes opening from the interior to the groove which are filled by material of the band so that the band is anchored against centrifugal and accelerating forces. Advantageously the band is formed by injection molding the band of plastic material which is formed into the openings formed in the groove and have a sufficient amount so as to form an annular ring on the interior of the shell body.

This absolutely secure anchoring of the plastic rotating band in the provided annular groove does not need any undercuts, intermediate webs, or knurling on the bottom of the groove or the webs. The securing is simple and inexpensive.

According to a development of the invention, the rotating band may be formed by injection molding directly in the annular groove and the radial apertures extending therefrom through the shell and form a ring portion on the inside surface of the shell. The apertures may be circular, rectangular, trapezoidal, or polygonal.

According to another development of the invention, the ring portion extending on the inside surface of the shell may be positively enclosed in a groove or recess of a shell bottom which is inserted in the projectile body. This includes designs in which, not a closed ring portion, but separate portions of the rotating band protrude through the apertures in the shell and are enclosed by the shell bottom.

The rotating band thus serves at the same time as a connecting element between the body and the bottom of the projectile.

According to the invention, the bottom of the projectile may be united with the rotating band. That is, the ring portion and thus the rotating band, may be made integral with the projectile bottom. In such a case, the bottom may be provided with cavities which, functionally, are filled with inserts. This makes the projectile body the sole part which forms the projectile proper. The inserts and cavities may be used for balancing the weight of the projectiles.

Accordingly it is an object of the invention to provide a shell which includes a hollow body having a groove an its exterior surface in which a rotating band is positioned and wherein the band is held in place by portions of the band which extend through openings formed in the groove.

A further object of the invention is to provide a projectile which is simple in design rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 2:
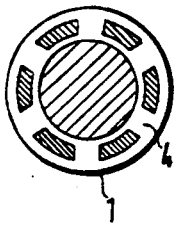
FIG. 2 is a sectional view taken along the line II—II of FIG. 1.
Figure 1:
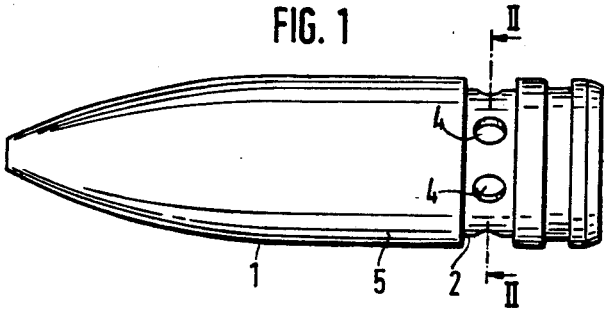
FIG. 1 shows a projectile body with an annular groove and apertures therein.
Figure 4:
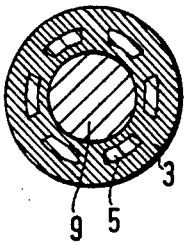
FIG. 4 is a cross sectional view taken along the line IV—IV of FIG. 3.
Figure 3:
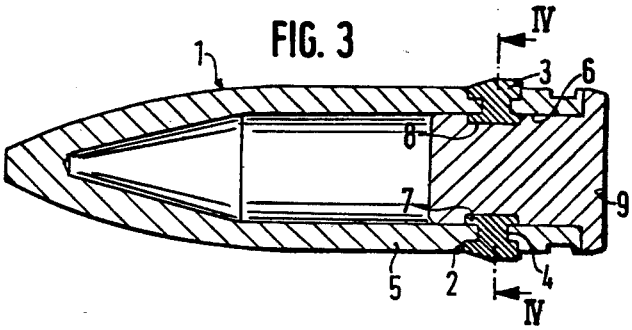
FIG. 3 shows a projectile with a rotating band of plastic.
Figure 6:
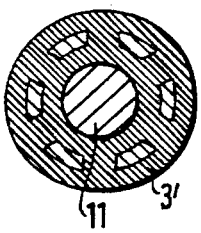
FIG. 6 is a sectional view taken along the line VI—VI of FIG. 5.

Referring to the drawings in particular the invention embodied therein comprises a projectile which includes a hollow shell body 1 and which is particularly in use for rapid fire weapons and high performance guns. In accordance with the invention the projectile is provided with an annular groove 2 on its exterior surface with openings formed through the groove to interior and which includes a rotatable band of plastic material which arranged in the groove and includes portions thereof which extend through the opening.

A projectile body 1 is provided in its rear portion with an annular groove 2 for a rotating band 3 of plastic. In the bottom of annular groove 2, apertures 4 are provided which are distributed over the circumference and extend radially of the shell 5 of the projectile.

Rotating band 3 made of plastic is injection-molded directly in groove 2 and in apertures 4, and forms a closed ring portion 7 on the inside surface 6 of projectile shell 5, radially beneath groove 2. Instead of a closed ring portion, separate portions of plastic having penetrated apertures 4 may be formed beneath groove 2, of course. Ring portion 7 is enclosed in a corresponding groove or recess 8 provided in the bottom portion 9 of the projectile. The bottom 9 is thus positively connected to the body 1 of the projectile.

Figure 5:
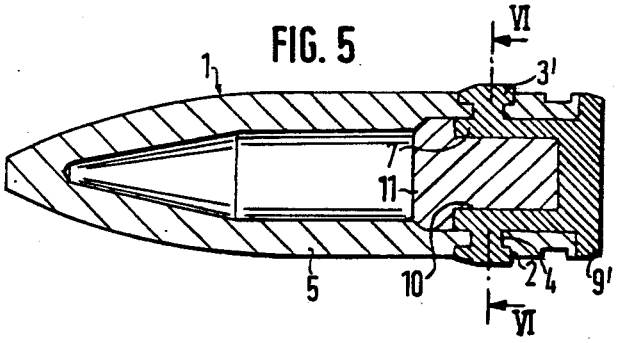
FIG. 5 shows another design of the projectile with a rotating band of plastic.

According to FIG. 5, a rotating band 3' of plastic is made integral with a bottom 9' of a projectile. A cavity 10 is formed in the bottom, in which an insert 11, preferably of a plastic, is fittingly received, serving to balance the weight. Then, only the metallic part, namely the projectile body 2 or shell 5, forms the projectile proper.

Only simple operations are required for manufacturing the inventive projectile body, namely operations for producing the annular groove and apertures therein. These are substantially orthogonal machining and drilling operations, without undercuts or knurling. The inventive connection between the rotating band of plastic and the projectile body is absolutely safe and firm and withstands all the occurring centrifugal and angular accelerating forces.

While specific embodiments of the invention have been shown and described in detail to illustrate the application of the principles of the invention, it will be understood that the invention may be embodied otherwise without departing from such principles.

What is claimed is:

1. A projectile particularly for use in rapid fire weapons and high performance guns, comprising a hollow projectile body having an exterior surface with an annular groove therearound with apertures extending through the groove to the interior of said body distributed around the periphery of the groove, and a rotating band positioned in the groove secured against displacement caused by centrifugal accelerating forces by portions of the band which project into the apertures.

2. A projectile according to claim 1, wherein said band is an injection molded portion formed directly in the groove and provided with molded portions which extend into the openings and form a closed ring on the interior of said projectile body.

3. A projectile according to claim 1, wherein the apertures formed in said body are circular bores.

4. A projectile according to claim 1, wherein said apertures formed in the groove are rectangular.

5. A projectile according to claim 1, wherein the apertures in the groove are trapezoidal.

6. A projectile according to claim 1, wherein the apertures in the groove are polygonal.

7. A projectile according to claim 1, wherein said band includes a ring portion formed in the interior of said shell body and having portions which extend through the openings to the band arranged in the groove on the exterior of said body.

8. A projectile according to claim 1, wherein said projectile includes a forward closed portion and an opened rear portion and including a projectile bottom member positioned in the rear portion and extending into the interior of said body and wherein said band includes a ring portion formed on the interior of said body and engaged on said bottom.

9. A projectile according to claim 8, wherein said bottom includes an annular ring portion, said band being formed integrally with a portion of said bottom and having portions extending through the openings to said bottom.

10. A projectile according to claim 8, wherein said band is formed integrally with a bottom member, said bottom member comprising a cup shaped member extending into the open end of said shell the outer portions of the walls thereof forming a portion of said rotating band and including an insert extending into the bottom on the interior of said shell.

* * * * *